US006565085B1

(12) United States Patent
Kornafel

(10) Patent No.: US 6,565,085 B1
(45) Date of Patent: May 20, 2003

(54) PARLOR GAME OF CHANCE APPARATUS

(76) Inventor: Stanley Edward Kornafel, 668 Mohawk Ave., Norwood, PA (US) 19074

( * ) Notice: Subject to any disclaimer, the term of this patent is extended or adjusted under 35 U.S.C. 154(b) by 44 days.

(21) Appl. No.: 09/672,885

(22) Filed: Sep. 27, 2000

(51) Int. Cl.[7] ..... A63F 3/00
(52) U.S. Cl. ..... 273/138.1; 273/146
(58) Field of Search ..... 463/16, 22; 273/138.1, 273/139, 268, 146

(56) References Cited

U.S. PATENT DOCUMENTS 5,340,113 A * 8/1994 Respicio 5,662,325 A * 9/1997 Weyand

* cited by examiner

*Primary Examiner*—William M. Pierce

(57) ABSTRACT

An original game for play apparatus is disclosed which provides through chance and competition a winner by the highest score. This device not found in other art is originally designed to provide fun through the use of playing pieces, of guessing and personal notions with the excitement of the resulting realization of the skillful use thereof. The unique concept is that a plurality of playing pieces devised in a manner to enable coded combinations, are conjunctively used with a printed chart about the rules of predetermined combinations and other novelties providing values of the coded combinations enabling scoring and a winner.

2 Claims, 2 Drawing Sheets

| WEATHER REPORT (4) | NO FORECAST (7) | FORECAST CORRECT (5) | FORECAST INCORRECT (6) |
|---|---|---|---|
| OPTION A: W W W W | +8 | +30 | −9 |
| OPTION B: W W W R | +6 | +26 | −8 |
| OPTION C: W W W G | +6 | +22 | −7 |
| OPTION D: W W R R | +5 | +18 | −6 |
| OPTION E: W W R G | +5 | +15 | −5 |
| OPTION HH: A, B, OR C | | +8 | −3 |
| OPTION JJ: D OR E | | +10 | −4 |
| OPTION KK: A, B, C, D, E | | +5 | −2 |

(9)

(2)

| FOR USE BY PLAYER WITH "NO" FORECAST IF THERE ARE NO MATCHES PLAYER RECIEVES (2) POINTS | |
|---|---|
| UNSETTLED SKIES | |
| B B B R G | −6 TO YOU OR +10 TO ANOTHER PLAYER |
| B R G G G | −4 TO YOU OR +8 TO ANY TWO PLAYERS |
| B B R G G | −2 TO YOU OR +4 TO ALL OTHER PLAYERS |
| OVERCAST | |
| B B B G G | −10 TO YOU OR +16 TO ANOTHER PLAYER |
| B B G G G | −6 TO YOU OR +10 TO ANY 2 PLAYERS |
| B R R G G | −4 TO YOU OR +6 TO ALL OTHER PLAYERS |

(8)

FIG 1

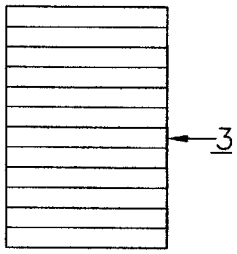

FIG 2

PARLOR GAME OF CHANCE APPARATUS

CROSS REFERENCE TO RELATED APPLICATIONS

The set of disks used in a board game as a second chance means by the same inventor. application Ser. No. 09/167,089

STATEMENT REGARDING FEDERALLY SPONSORED RESEARCH OF DEVELOPMENT:

Not Applicable

REFERENCE TO MICROFICHE APPENDIX:

Not Applicable

BACKGROUND OF THE INVENTION AND PRIOR ART

This invention relates to games and in particular to parlor type games of chance utilizing playing pieces and their method of use.

In prior art methods of choice and chance have previously provided players the norm of success using dice, spinners, balls, chips, etc. via the accumulation of value, items or points of the items and or the elimination of the same and though praiseworthy these art forms may be limited in the intenseness of feelings, the requirement of guessing or drawing on personal notions which this instant invention more sufficiently addresses and provides.

Unknown is any prior art containing the formulated manner of equipment, its' use, plus the method of play and dynamics of scoring enabled by this invention.

Classes of search performed: 40/372, 144, 145 , 52/DIG10, 238, 256, 273 , 290, 291, 312, 434 and 463. Examples of Prior Art with Relevance:

| U.S. Pat. No. # | Inventor | Month & Year |
|---|---|---|
| 7,756 | Richardson | June, 1877 |
| 689,870 | Graham | December, 1901 |
| 1,061,999 | Grondahl | May, 1913 |
| 2,026,082 | Darrow | October, 1935 |
| 3,033,572 | Thibault | May, 1962 |
| 4,999,001 | Johnson | March, 1991 |
| 5,340,113 | Respicio | August, 1994 |

BRIEF SUMMARY OF THE INVENTION

This invention comprises of an originally designed manner of identifying pieces and a contrived format for applying a solely unique method of scoring providing an original conjunctival method of use enabling a complete game not found in any prior art.

It is generally accepted that the name of title of something may relate to its field or application thus any field or substance may be aesthetically related to an invention's atmosphere wherefore the inventor herein chose the weather.

Unlike the limited joy of the dice, spinner, ball or other mechanism the concept of this invention provides greater lasting joy and player involvement through necessitation of guessing and with increasing anticipation by requiring the visual of many pieces of a uniquely designed manner of equipment and the coordinating same with a chart within the rules. The originally designed method of scoring, enables longer moments of excitement with the final result being also pending on the players choice at the beginning of the players' turn. It is the designed and contrived manner of equipment, designed format of scoring, and conjunction of the pieces with the designed method of scoring as enabled in the rules which provides a new, original and different game of chance, perception, guessing and fun yet with the ages of old object of winning by the highest score.

BRIEF DESCRIPTION OF THE VIEWS OF THE DRAWINGS

Illustrated in the drawings are the equipment used herein a set of six (6) disks and the chart a part of the rules.

FIG. 1 shows a plan view of the chart 2 which is a part of the rules.

FIG. 2 shows a perspective view of a plurality of the pieces 3 as herein used are disks.

Figure 3:
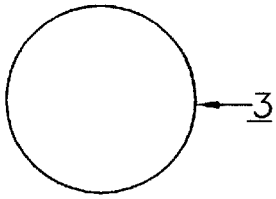
FIG. 3 shows a plan view of the top of one of the pieces.
Figure 4:
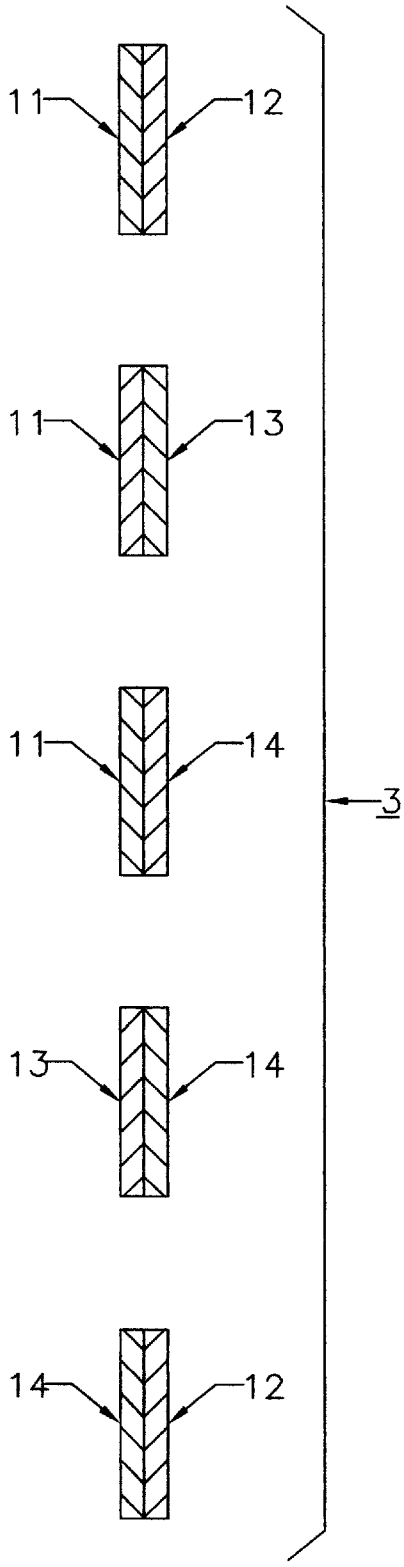
FIG. 4 shows an elevation view of the pieces 3 with the indicia being herein colors as used in the chart 2. Said colors being designated by numbers as follows.

11=white, 12=gray, 13=red and 14=black.

DETAILED DESCRIPTION OF THE INVENTION

Games Purpose: A game of chance with rules, enabling guessing and perception to provide a winner.

*List of described features and identifying number:

Chart=2

Playing pieces=3

"Weather Report" column=4

"Forecast Correct" column=5

"Forecast Incorrect" column=6

"No Forecast" column=7

"Unsettled Skies/Overcast" section=8

"Options and Groups"=9

Referencing to the rules of play the object of the game is to be the winning player by reaching an established winning score and having the highest score. The rules require a predetermined total score for winning and the sequence of players be established. The player in turn must first indicate the players' decision: Not to guess OR to guess. If the players' choice is of guessing then the player's guess is taken from the chart 2 for the rules with the choice of a single option 9 or a single group 9.

Said player of turn after indicating choice shakes the set of pieces 3 of any quantity herein being six (6) disks. Said pieces of any shape other than a sphere, but are herein disks 3 a composition of any material to enable a firm, or rigid finish so as to be handled and retain its shape, and of any size or variety of sizes but of reasonable size to enable being shaken or mixed and having any predetermined form and variety of indicia, herein having colors with said colors as follows: two (2) each: white on one side gray on the other side: one (1) each: white on one side red on the other side; one (1) each: white on one side, black on the other side; one (1) each: black on one side, red on the other side; one (1) each: black on one side gray on the other side.

The chart 2 is any predetermined manner of established criteria to enable some interfacing with the player and also some interfacing or interaction with the pieces 3.

After shaking or mixing, the player allows the pieces 3 to empty onto any flat surface where as they lay so they read by the indicia of the sides showing. The showing of the pieces 3 are then matched with the "Weather Report"

column 4 of the chart 2. The indicia of any manner or established formulae but herein are used colors with said colors being on the chart 2 are designated by the first letter of the name of the color as follows:

W=white, B=black, G=gray and R=red.

Where said player has elected to guess and the indicia of the tossed pieces correspond to the "Weather Report" column 4 plus match the players' selection the player receives an advantageous corresponding score as provided by the "Forecast Correct" column 5, but if the player is incorrect the player would receive a negatively corresponding score as provided by the "Forecast Incorrect" column 6.

Example: Where player to have chosen Option D 9 on the chart 2 and the colors of the pieces to show WWRR, a match would occur enabling a score from the "Forecast Correct" column 5 of 18 points. Now where the color code of the tossed disks would be different from the players' choice there would be no match resulting in the player to receive the score from the "Forecast Incorrect" column 6 causing the player to deduct 6 points.

Where said player has elected not to guess, said player then tosses the pieces with the following possible results for scoring: Where the colors match a group or an option 9 in the "Weather Report" column 4 the player receives the points in the corresponding "No Forecast" column 7. Where the colors may match the "Weather Report" column 4 of the "No Forecast—Unsettled Skies or Overcast" section 8 of the chart the player according to the match would follow the corresponding directions to either deduct points from his or her score or add points to other players or; where there is no match the player receives two (2) points gratis. It is where player does not guess and none of the weather occurs then all other combinations favor player to receive (2) two points. All players accept all minus or deducting amounts but not accumulating more than a minus twenty (−20) at any time. Player to reach the predetermined winning score and having the highest is the winner.

This is the general manner of usage and operation of this invention and herein below are the rules and the chart 2 as consideration to be only as part of the description.

Players decide and establish sequence of play and the winning score before the game begins. Players start their turn by choosing their decision to forecast or not to forecast. They do this by: 1. Writing "No" on their score sheet for No Forecast—or—2. Writing a Letter Option which is One of the following: "A", "B", "C", "D", "E", "HH", "JJ", "KK" (see Weather Report column on Weather Chart). Note: You Must make a choice and write it on the score sheet or no score will be received. A player may have a different predication on each and every turn, if so desired. "Unsettled Skies" and "Overcast" may never be a predication at any time for any player. Place the Weather Quacker Disks in the tumbler and toss. There are no retosses except if a Weather Quacker stands on end. Then All disks must be retossed. Where disks land, so they read: Red=R, Gray=G, White=W, Black=B.

Score is determined by matching the tossed Weather Quackers with the Weather Report on the Weather Chart. In the case of two or more matching Weather Reports, the higher score applies. Scoring: Score is determined from that which applies exactly from the Weather Chart—the combination you get is the score, No Changing or Mixing of Combinations! Players must accept all minus or deducting scores, but can not accumulate a score of more than a minus twenty (−20) at any given time, thus all additional scores past −20 is disregarded and eliminated. The game is over when all players complete their turn and the established game total has been reached or exceeded by at least one (1) player. The player with the highest score wins. Tie Breakers: 3 turns for each player in a tie—Players Must Forecast—Highest total wins the game. NO Forecast Scores if you choose "No" for your turn and: Match a Weather Report, your score is taken from the "No Forecast" column on the Weather Chart. Match (2) Weather Reports, your score is taken from the higher "No Forecast" score on the chart. Match a Weather Report is "Unsettled Skies" or "Overcast" you must choose to either deduct the amount from your score or add the amount to another player's score as directed. Do Not Match any of the Weather Reports, then all other combinations favor player to receive (2) points. Forecast Scores If you choose a Letter or Group Item for your turn And: Match a Weather Report, your score is taken from the "Pleasant" column on the Weather Report. Match (2) Weather Report, your score is taken from the higher "Pleasant" score on the chart. Do Not Match a Weather Report, your score is taken from the "Turbulent" column on the Weather Chart.

CHART 2

| WEATHER REPORT 4 | NO FORE-CAST 7 | FORE-CAST COR-RECT 5 | FORE-CAST IN-CORRECT 6 |
|---|---|---|---|
| Option A: W W W W | +8 | +30 | −9 |
| 9 Option B: W W W R | +6 | +26 | −8 |
| Option C: W W W G | +6 | +22 | −7 |
| 9 Option B: W W R R | +5 | +18 | −6 |
| Option C: W W R G | +5 | +15 | −5 |
| Group Option HH: A, B, or C | | +8 | −3 |
| 9 Group Option JJ: D or E | | +10 | −4 |
| Group Option KK: A, B, C, D, E | | +5 | −2 |

For Use By Player With "NO" Forecast
*If there are no matches player receives (2) Points 8

| | |
|---|---|
| UNSETTLED SKIES - 8 | |
| B B B R G | −6 to you OR +10 to another player |
| B R G G G | −4 to you OR +8 to any 2 players |
| B B R G G | −2 to you OR +4 to all other players |
| OVERCAST- 8 | |
| B B B G G | −10 to you OR +16 to another player |
| B B G G G | −6 to you OR +10 to 2 other players |
| B R R G G | −4 to you OR +6 to all other players |

The above rules and chart shown as part of the description are illustrative and for description only and without limiting or limitations on construction, operation, modifications or changes, or changes from aesthetics, assembly or manufacture. The intended means of this herein invention may be embodied in other specific forms thus the described embodiments are to be all considered illustrative and not restrictive in all aspects with the scope of the invention to be realized by the appended claims more properly than the detailed description intending all changes to come within the meaning of the claims.

What I claim as my invention is:

1. A method of playing a game where players choose to forecast or not forecast indicia randomly to be shown by a plurality of playing pieces with consequences provided by a chart and: a) a player making a decision to forecast or not forecast in selecting one of several options capable of being produced by a provided set of a plurality of pieces wherein each piece is capable of randomly showing indicia and said set of pieces is capable of producing several options based on indicia shown by each piece; and b) the player on a provided score sheet writing their decision not to forecast or forecast indicating their choice of options from a provided chart; and c) said chart having a list of predetermined select options and points associated with each select option for players that decide not to forecast and also to forecast and are correct and also to forecast and are incorrect; and d) the player manipulating the set of playing pieces to produce an option based on the combination of indicia and comparing said option to the list of predetermined options on said chart then receives positive or negative points depending upon whether player decided not to forecast or decided to forecast and was correct or incorrect and wherein the points associated for players who decided not to forecast is more than for players who decided to forecast and incorrect but less than for players who decided to forecast and correct; and e) said chart is further provided a second list of options with each of the options having associated therewith points subtracted from the player or points added to another player wherein said player deciding not to forecast as in steps (a) and (b) must choose between subtracting points from said player or adding points to another player or players if the option produced by the playing pieces in step (d) matches one of the second list of options of the chart and wherein said player choosing not to forecast and the resulting play of the pieces produces no match of any option of said chart the player by the chart is awarded complementary minimal amount of points but said points not being higher than any other points for the chart; and (f) each player repeating steps (a) through (e) until a predetermined number of points is obtained by a player declaring that player a winner.

2. A method of playing a game as in claim 1 where said set of playing pieces comprises a plurality of geometric shapes of any size and material composition being of a firm or semi rigid finish to enable being handled yet retain the same shape and of any indicia or colors but of a designed format with the actual indicia being insignificant but established with the first piece having indicia being different on one side from the other with a second piece having indicia different on one side from the other side but being different than said first piece with additional pieces to have the same or different from first, second and other pieces with said pieces the quantity is important only to correspond and conjunct with an established chart.

* * * * *